US010063976B2

(12) United States Patent
Oishi et al.

(10) Patent No.: US 10,063,976 B2
(45) **Date of Patent: *Aug. 28, 2018**

(54) HEADPHONES FOR STEREO TACTILE VIBRATION, AND RELATED SYSTEMS AND METHODS

(71) Applicant: Skullcandy, Inc., Park City, UT (US)

(72) Inventors: Tetsuro Oishi, Santa Barbara, CA (US); John Timothy, Salt Lake City, UT (US); Sam Noertker, Park City, UT (US)

(73) Assignee: Skullcandy, Inc., Park City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/405,918

(22) Filed: Jan. 13, 2017

(65) Prior Publication Data

US 2017/0150267 A1 May 25, 2017

Related U.S. Application Data

(63) Continuation of application No. 14/586,589, filed on Dec. 30, 2014, now Pat. No. 9,549,260.
(Continued)

(51) Int. Cl.
*H04R 5/033* (2006.01)
*H04R 5/04* (2006.01)

(52) U.S. Cl.
CPC ..... *H04R 5/033* (2013.01); *H04R 5/04* (2013.01); *H04R 2205/022* (2013.01); *H04R 2400/03* (2013.01)

(58) Field of Classification Search
CPC ... H04R 3/04; H04R 2201/028; H03F 1/3211; H03F 1/34; H03F 3/187; H03F 3/26; H03F 3/3069; H03F 2203/45112
See application file for complete search history.

(56) References Cited

U.S. PATENT DOCUMENTS 5,173,944 A 12/1992 Begault
5,661,808 A 8/1997 Klayman et al.
(Continued)

FOREIGN PATENT DOCUMENTS

EP 2101517 B1 8/2011
EP 2530956 A1 12/2012
(Continued)

OTHER PUBLICATIONS

European Search Report for European Application No. EP14200637 dated May 18, 2015, 6 pages.
(Continued)

*Primary Examiner* — Mark Fischer
(74) *Attorney, Agent, or Firm* — TraskBritt

(57) ABSTRACT

Headphones for stereo tactile vibration, and related systems and methods are disclosed. A headphone comprises a first speaker assembly including a first audio driver and a first tactile bass vibrator. The headphone also comprises a second speaker assembly including a second audio driver and a second tactile bass vibrator. The headphone further comprises a signal processing circuit configured to generate a first tactile vibration signal and a second tactile vibration signal from an audio signal to be received by the headphone. The first tactile vibration signal differs from the second tactile vibration signal. A method of operating the headphone includes generating the first tactile vibration signal and the second tactile vibration signal, and driving vibration of the first and second tactile bass vibrators with the first and second tactile vibration signals, respectively. A stereo tactile vibrator system includes the headphone.

13 Claims, 12 Drawing Sheets

Related U.S. Application Data

(60) Provisional application No. 61/921,979, filed on Dec. 30, 2013.

(56) References Cited

U.S. PATENT DOCUMENTS

| | | | | |
|---|---|---|---|---|
| 7,920,708 | B2 | 4/2011 | Trautmann et al. | |
| 8,175,302 | B2 | 5/2012 | Tanghe et al. | |
| 8,290,192 | B2 | 10/2012 | Wong et al. | |
| 8,311,239 | B2 | 11/2012 | Kim et al. | |
| 9,549,260 | B2 * | 1/2017 | Oishi | H04R 5/033 |
| 2007/0274548 | A1 | 11/2007 | Huang | |
| 2008/0240484 | A1 | 10/2008 | Tanghe et al. | |
| 2009/0180646 | A1 | 7/2009 | Vulfson et al. | |
| 2009/0225992 | A1 | 9/2009 | Kongai | |
| 2011/0135098 | A1 | 6/2011 | Kuhr et al. | |
| 2013/0202134 | A1 | 8/2013 | Afshar | |
| 2014/0056459 | A1 | 2/2014 | Oishi et al. | |
| 2014/0185812 | A1 | 7/2014 | Van Achte et al. | |
| 2015/0189441 | A1 | 7/2015 | Oishi et al. | |

FOREIGN PATENT DOCUMENTS

| | | | |
|---|---|---|---|
| WO | 35243 | A2 | 6/2000 |
| WO | 2013052883 | A1 | 4/2013 |

OTHER PUBLICATIONS

Wikipedia, Subharmonic synthesizer, published by Internet Archive WayBack Machine on Apr. 1, 2013, https://web.archive.org/web/20130401002901/http://en.wikipedia.org/wiki/Subharmonic_synthesizer.

* cited by examiner

HEADPHONES FOR STEREO TACTILE VIBRATION, AND RELATED SYSTEMS AND METHODS

CROSS-REFERENCE TO RELATED APPLICATIONS

This application is a continuation of U.S. patent application Ser. No. 14/586,589, filed Dec. 30, 2014, now U.S. Pat. No. 9,549,260, issued Jan. 17, 2017, which claims the benefit of U.S. Provisional Patent Application Ser. No. 61/921,979, filed Dec. 30, 2013, the disclosure of each of which is hereby incorporated herein in its entirety by this reference.

TECHNICAL FIELD

The present disclosure relates to a headphone for providing stereo tactile vibration, to related systems including such a headphone, and to methods of fabricating and using such a headphone.

BACKGROUND

The audio frequency range is accepted by many to be about 20 Hz (Hertz) to 20 kHz (kilohertz), although some people are able to hear sounds above and below this range. Also, a bass frequency range is accepted by many to be about 16 Hz to 512 Hz. It may be relatively difficult for a person to detect which direction a bass frequency sound is coming from because the wavelength associated with bass frequency sound is larger than the distance between a person's ears (usually less than 1 ft (foot)). For example, assuming that the speed of sound is 340 m/s, the wavelength associated with a frequency of 100 Hz is about 11 ft. As a result, recording engineers have conventionally mixed bass frequencies as monophonic (mono).

BRIEF SUMMARY

In some embodiments, the present disclosure comprises a headphone. The headphone comprises a first speaker assembly including a first audio driver and a first tactile bass vibrator. The headphone also comprises a second speaker assembly including a second audio driver and a second tactile bass vibrator. The headphone further comprises a signal processing circuit. The signal processing circuit is configured to generate a first tactile vibration signal and a second tactile vibration signal from an audio signal to be received by the headphone. The first tactile vibration signal drives vibration of the first tactile bass vibrator. The second tactile vibration signal drives vibration of the second tactile bass vibrator. The first tactile vibration signal differs from the second tactile vibration signal.

In some embodiments, the present disclosure comprises a stereo tactile vibrator system. The stereo tactile vibrator system comprises a headphone. The headphone includes a signal processing circuit. The signal processing circuit is configured to generate a first tactile vibration signal and a second tactile vibration signal from an audio signal to be received by the headphone. The first tactile vibration signal differs from the second tactile vibration signal. The headphone also includes a first speaker assembly including a first audio driver and a first tactile bass vibrator configured to vibrate responsive to the first tactile vibration signal. The earphone device further includes a second speaker assembly including a second audio driver and a second tactile bass vibrator configured to vibrate responsive to the second tactile vibration signal.

In some embodiments, the present disclosure comprises a method of operating a headphone. The method comprises generating a first tactile vibration signal and a second tactile vibration signal from an audio signal. The first tactile vibration signal is different from the second tactile vibration signal. The method also comprises driving vibration of a first tactile bass vibrator comprised by a first speaker assembly with the first tactile vibration signal. In addition, the method comprises driving vibration of a second tactile bass vibrator comprised by a second speaker assembly with the second tactile vibration signal.

DETAILED DESCRIPTION

Figure 1:
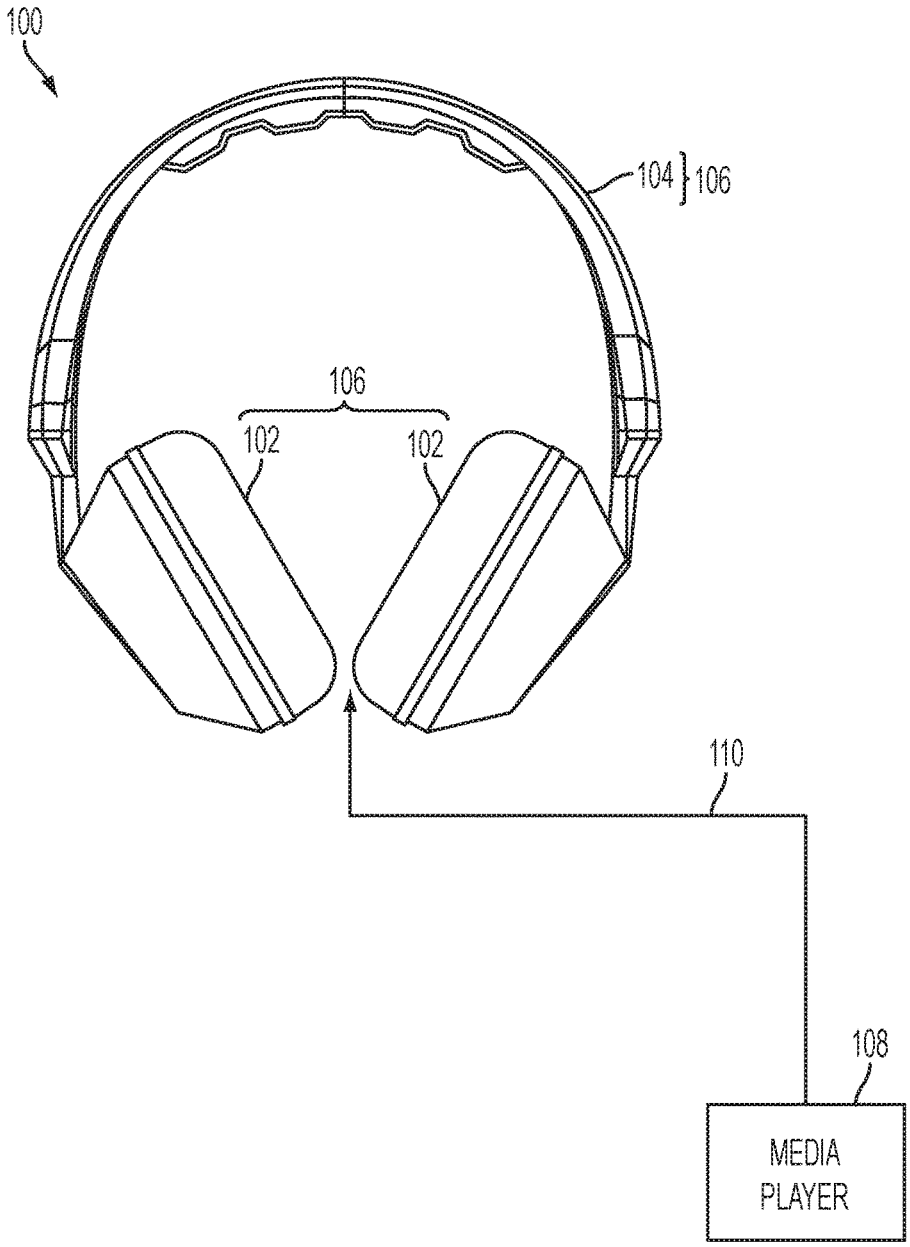
FIG. 1 is a simplified view of an embodiment of a stereo tactile vibrator system of the present disclosure.

The illustrations presented herein are not meant to be actual views of any particular apparatus (e.g., device, system, etc.) or method, but are merely idealized representations that are employed to describe various embodiments of the present disclosure. The drawings are not to scale.

Information and signals described herein may be represented using any of a variety of different technologies and techniques. For example, data, instructions, commands, information, signals, bits, symbols, and chips that may be referenced throughout the description may be represented by voltages, currents, electromagnetic waves, magnetic fields or particles, optical fields or particles, or any combination thereof. Some drawings may illustrate signals as a single signal for clarity of presentation and description. It should be understood by a person of ordinary skill in the art that the signal may represent a bus of signals, wherein the bus may have a variety of bit widths and the present disclosure may be implemented on any number of data signals including a single data signal.

The various illustrative logical blocks, modules, circuits, and algorithm acts described in connection with embodiments disclosed herein may be implemented as electronic hardware, computer software, or combinations of both. To clearly illustrate this interchangeability of hardware and software, various illustrative components, blocks, modules, circuits, and acts are described generally in terms of their functionality. Whether such functionality is implemented as hardware or software depends upon the particular application and design constraints imposed on the overall system. The described functionality may be implemented in varying ways for each particular application, but such implementation decisions should not be interpreted as causing a departure from the scope of the embodiments of the disclosure described herein.

In addition, it is noted that the embodiments may be described in terms of a process that is depicted as a flowchart, a flow diagram, a structure diagram, or a block diagram. Although a flowchart may describe operational acts as a sequential process, many of these acts can be performed in another sequence, in parallel, or substantially concurrently. In addition, the order of the acts may be re-arranged. A process may correspond to a method, a function, a procedure, a subroutine, a subprogram, etc. Furthermore, the methods disclosed herein may be implemented in hardware, software, or both. If implemented in software, the functions may be stored or transmitted as one or more instructions or code (e.g., software code) on a computer-readable medium. Computer-readable media includes both computer storage media and communication media including any medium that facilitates transfer of a computer program from one place to another.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. Also, unless stated otherwise a set of elements may comprise one or more elements.

Embodiments of the present disclosure include systems and related methods for stereo tactile vibration in a headphone. It should be noted that while the utility and application of the various embodiments of the present disclosure are described with reference to stereo vibration for headphones to enhance directional detection using tactile sensation, embodiments of the present disclosure may also find utility in any application in which stereo tactile vibration may be helpful or desirable.

A "bass frequency range" is a relatively low audible frequency range generally considered to extend approximately from 16 Hz to 512 Hz. For purposes of this disclosure, a "low bass frequency range" refers to bass frequencies that may be felt (in the form of tactile vibrations) as well as heard. The low bass frequency range extends from about 16 Hz to about 200 Hz.

A "bass component" of a signal is a portion of the signal that oscillates in the entirety of the bass frequency range, or subsets of the entirety of the bass frequency range. By way of non-limiting example, the bass component may include a "low bass component" of a signal, which is the portion of the signal that oscillates in the low bass frequency range. Of course, there are infinite contemplated permutations of frequencies in the bass frequency range that may be referred to by the term bass component, as used herein.

A "non-bass component" of a signal is a portion of the signal that oscillates in the entirety or a subset of the frequency range above the frequency range spanned by the bass component of the signal. As the bass component may, in some embodiments, span only a portion of the entire bass frequency range, the non-bass component may overlap part of the bass frequency range.

In some instances, it may be desirable to mix bass in stereo, despite the fact that in typical environments, bass frequencies are perceived as being non-directional. For example, video game recording engineers may mix bass in stereo to provide video game users directional information pertaining to sounds with strong bass undertones (e.g., sounds from explosions, firearms, or vehicles). The directional information may be particularly apparent to people listening to the sound through a stereo headphone.

FIG. 1 is a simplified view of an embodiment of a stereo tactile vibrator system 100 according to an embodiment of the present disclosure. The stereo tactile vibrator system 100 may include a stereo headphone 106 and a media player 108 configured to transmit an audio signal 110 to the headphone 106. The media player 108 may be any device or system capable of producing an audio signal 110. For example, the media player 108 may include a video game console, a television, a cable or satellite receiver, a digital music player, a compact disc (CD) player, a radio, a stereo system, a cassette player, a mobile phone, a smart phone, a personal digital assistant (PDA), an eBook reader, a portable gaming system, a digital versatile disc (DVD) player, a laptop computer, a tablet computer, a desktop computer, a microphone, etc., and combinations thereof.

The media player 108 may be configured to provide a stereo audio signal 110 to the headphone. In other words, the audio signal 110 may include two channels (e.g., a right channel and a left channel), and the audio signal 110 may differ between the two channels. In some embodiments, the media player 108 may provide an audio signal 110 that includes stereo low bass frequencies. In other words, the low bass frequencies of one channel may differ from the low bass frequencies of the other channel in the audio signal 110 output by the media player 108 to the headphone 106. In other embodiments, the media player 108 may provide an audio signal 110 that includes monophonic low bass frequencies. In other words, the low bass frequencies of one channel may be at least substantially identical to the low bass frequencies of the other channel in the audio signal 110 output by the media player 108 to the headphone 106.

The headphone 106 may be configured to receive the audio signal 110 from the media player 108. The headphone 106 may include a pair of speaker assemblies 102 (referred to herein individually as "speaker assembly 102," and together as "speaker assemblies 102"). In some embodiments, the headphone 106 may also optionally include a headband 104 configured to rest on a user's head and provide support for the speaker assemblies 102. In some embodiments, the speaker assemblies 102 may be supported at least partially by the user's ears. In some embodiments, the headphone 106 may not include a headband 104.

Each speaker assembly 102 may include both an audio driver (i.e., a "speaker") and a tactile bass vibrator. For example, each speaker assembly 102 may comprise an audio driver and a tactile bass vibrator as described in U.S. patent application Ser. No. 13/969,188, which was filed Aug. 8, 2013 in the name of Oishi et al., now U.S. Pat. No. 8,965,028, issued Feb. 24, 2015, the disclosure of which is hereby incorporated herein in its entirety by this reference.

The headphone 106 may be configured to convert the audio signal 110 to audible sound and a stereo tactile response (e.g., stereo tactile vibrations). In other words, in addition to producing audible sound, each of the speaker assemblies 102 may be configured to produce tactile vibrations based, at least in part, on the audio signal 110. The stereo tactile vibrations may enhance a directional experience of a user listening to the speaker assemblies 102 as the user may feel directional information contained in the audio signal 110 through tactile vibrations, in addition to hearing the directional information.

Figure 2:
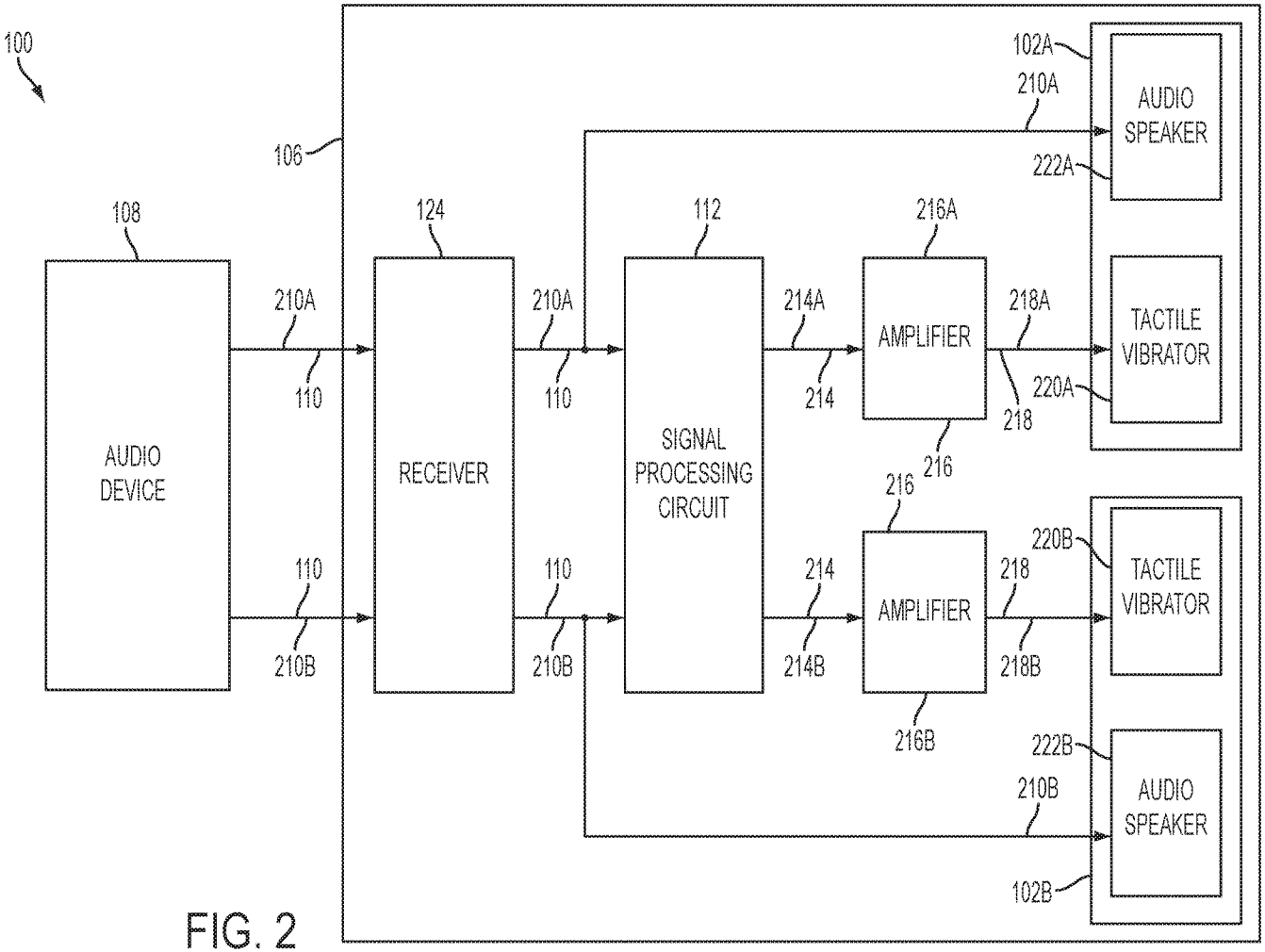
FIG. 2 is a simplified block diagram of the stereo tactile vibrator system of FIG. 1.

FIG. 2 is a simplified block diagram of the stereo tactile vibrator system 100 of FIG. 1. As previously discussed, the stereo tactile vibrator system 100 may include the headphone 106, which may be configured to receive the audio signal 110 from the media player 108. In some embodiments, the audio signal 110 may include at least a first signal 210A and a second signal 210B. For example, it is common for a media player 108 to produce stereo signals comprising a left signal and a right signal, which the headphone 106 may receive as the first signal 210A and the second signal 210B, respectively. As previously discussed, typically, low bass frequencies are often at least substantially the same in the first signal 210A and the second signal 210B, as sound engineers conventionally mix low bass frequencies monophonically.

The headphone 106 may include a signal processing circuit 112 operably coupled to a receiver 124. The signal processing circuit 112 may be configured to receive the audio signal 110 from the media player 108 through the receiver 124. The receiver 124 may include a wireless receiver, a cable assembly, a headphone jack, or combinations thereof. By way of non-limiting example, the receiver 124 may include a BLUETOOTH® or infrared receiver configured to receive the audio signal 110 wirelessly. As another non-limiting example, the receiver 124 may include an electrical cable assembly comprising a connector configured to mate with a connector of the media player 108.

The signal processing circuit 112 may also be configured to generate a first tactile vibration signal 214A and a second tactile vibration signal 214B (sometimes referred to herein together as "tactile vibration signals 214") from the audio signal 110. The first tactile vibration signal 214A may be different from the second tactile vibration signal 214B such that the tactile vibration signals 214 form a stereo tactile vibration signal. In some embodiments, the tactile vibration signals 214 may be derived, at least in part, from a bass component of the audio signal 110. By way of non-limiting example, the tactile vibration signals 214 may be derived, at least in part, from the entire bass frequency range content of the audio signal 110, one or more subsets of the bass frequency range content of the audio signal 110 (e.g., a low-bass component of the audio signal), or combinations thereof. In some embodiments, other components of the audio signal 110 from outside of the bass frequency range may be used to derive the tactile vibration signals 214 in addition to, or instead of, the bass component of the audio signal 110. By way of non-limiting example, the bass component of the audio signal 110 may be modulated by non-bass frequency range components of the audio signal 110 to produce the tactile vibration signals 214 if the bass component offers little to no directional information (i.e., if the bass is monophonic in the audio signal 110 output from the media player 108).

The signal processing circuit 112 may be further configured to deliver the tactile vibration signals 214 respectively to amplifiers 216A and 216B (sometimes referred to herein together as "amplifiers 216"). The amplifiers 216 may be configured to amplify the tactile vibration signals 214, resulting in a first amplified signal 218A, and a second amplified signal 218B (sometimes referred to herein together as "amplified signals 218"). The amplifiers 216 may be configured to provide additional current, voltage, or combinations thereof, for driving the tactile bass vibrators.

The headphone 106 may also include a first speaker assembly 102A and a second speaker assembly 102B (sometimes referred to herein together as "speaker assemblies 102"). The speaker assemblies 102 may each respectively comprise one of a first audio driver 222A, and a second audio driver 222B (sometimes referred to herein simply individually as "first audio driver 222A," and "second audio driver 222B," and together as "audio drivers 222"). The audio drivers 222 may be configured to receive and convert the audio signal 110 to audible sound that may be heard by the user. In addition, the speaker assemblies 102 may each respectively comprise one of a first tactile bass vibrator 220A, and a second tactile bass vibrator 220B (sometimes referred to herein simply individually as "tactile vibrator 220A," and "tactile vibrator 220B," and together as "tactile bass vibrators 220"). The tactile bass vibrators 220 may be configured to convert the amplified signals 218 to tactile vibrations that may be felt by the user. As a result, directional information from the audio signal 110 may be conveyed to the user both through stereo audio sounds, and through stereo tactile vibrations.

In some embodiments, the audio drivers 222 may generate some vibrations that may be felt by the user, in addition to the audio sound. For example, sound in the low-bass frequency range typically produces vibrations that may be felt. Consequently, the audio drivers 222 may contribute to the tactile vibrations provided by the tactile bass vibrators 220. Similarly, in some embodiments, the tactile bass vibrators 220 may generate some audio sound that may be heard by the user, in addition to the tactile vibrations. Consequently, the tactile bass vibrators 220 may contribute to the audio sound provided by the audio drivers 222.

In some embodiments, the speaker assemblies 102 may comprise the receiver 124, the signal processing circuit 112, and the amplifiers 216 in a variety of configurations. For example, one of the speaker assemblies 102 may comprise each of the receiver 124, the signal processing circuit 112, and the amplifiers 216. As another example, one of the speaker assemblies 102 may comprise the receiver 124, the signal processing circuit 112, and one of the amplifiers 216. The other speaker assembly 102 may comprise the other amplifier 216. In some embodiments, the headband 104 (FIG. 1) may comprise some or all of the receiver 124, the signal processing circuit 112, and the amplifiers 216.

As previously discussed, the speaker assemblies 102 may each comprise an audio driver 222A, or 222B, and a tactile bass vibrator 220A, or 220B. The aforementioned U.S. Pat. No. 8,965,028 to Oishi et al. similarly discloses a headphone including two speaker assemblies, each including an audio driver and a tactile bass vibrator. Oishi also discloses that a tactile bass vibrator may comprise a vibrating member mechanically coupled to a housing of each speaker assembly inside of, or outside of, the housing, by a suspension member. Oishi further discloses that a resonant frequency of the tactile bass vibrator is affected, at least in part, by the physical properties of the vibrating member and the suspension member, including the mass of the vibration member, the configuration of the suspension member, and the composition of the material of the suspension member. The speaker assemblies 102, the tactile bass vibrators 220, and the audio drivers 222 of the present disclosure may be configured in a similar manner to the speaker assemblies, the tactile bass vibrators, and the audio drivers, respectively, of Oishi.

As a resonant frequency of the tactile bass vibrators 220 may be affected by the physical properties of the tactile bass vibrators 220, the tactile bass vibrators 220 may be designed to have specific resonant frequencies. In some embodiments, the first tactile bass vibrator 220A and the second tactile bass vibrator 220B may be configured with substantially the same resonant frequency. As discussed in further detail below with reference to FIG. 9, in additional embodiments, each speaker assembly 102 may include two or more tactile bass vibrators 220 that exhibit different resonant frequencies to improve the vibrational response over a relatively wider range of bass frequencies.

In some embodiments, the tactile bass vibrators 220 may be removably coupled to the speaker assemblies 102. As the tactile bass vibrators 220 are configured to both deliver mechanical vibrations to the speaker assemblies 102 and receive electrical signals, the tactile bass vibrators 220 may be both mechanically and electrically coupled to the speaker assemblies 102. The removably coupled tactile bass vibrators 220 may be mechanically coupled to the speaker assemblies 102 to effectively transfer vibrations to the speaker assemblies 102. By way of non-limiting example, the tactile bass vibrators 220 may include threads or grooves configured to mate respectively with complementary grooves or threads in sockets of the housing of the speaker assemblies 102. Accordingly, the tactile bass vibrators 220 may be mechanically coupled to the speaker assemblies 102 by screwing the tactile bass vibrators 220 into the speaker assemblies 102. Also by way of non-limiting example, the removably coupled tactile bass vibrators 220 may be electrically coupled to the speaker assemblies 102 by pin connectors, clips, contact of solder points, other electrical connections known in the art, and combinations thereof.

In some embodiments, the removably coupled tactile bass vibrators 220 may be built into a detachable housing. The detachable housing may be an aesthetic component of the design of the headphone 106. Also, the housing may be a structural component of the headphone 106. In some embodiments, the detachable housing may include custom graphics for headphone collaborations or that indicate a resonant frequency of the enclosed tactile bass vibrator 220.

Figure 3:
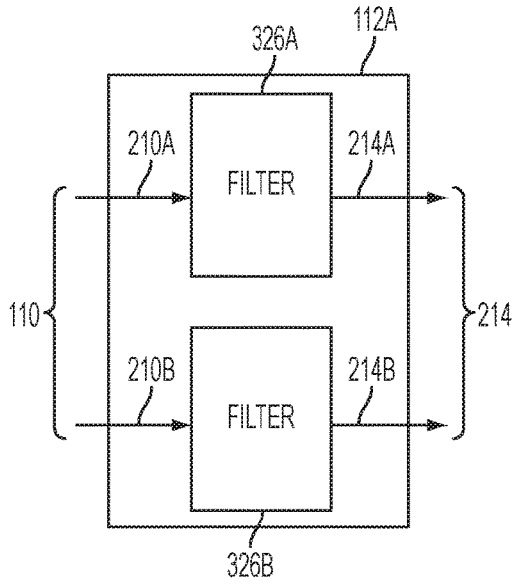
FIG. 3 is a simplified block diagram of a signal processing circuit according to an embodiment of the present disclosure.

In some embodiments, it may be known that the headphone 106 will be used in an environment where the audio signal 110 will likely be mixed with stereo bass (e.g., video gaming). In other words, it may be known that a bass component of the first signal 210A is different from a bass component of the second signal 210B. Also, in some embodiments the media player 108 may be configured as a computing device capable of executing software applications (e.g., mobile software applications), such as smart phones, tablet computers, laptop computers, desktop computers, smart televisions, etc. The media player 108 may be configured with application software that is configured to adjust the audio signal 110 such that the bass components are in stereo (e.g., similarly to the signal processing circuit 112B of FIG. 4) before the audio signal 110 is sent to the headphone 106. FIG. 3 illustrates an example implementation of a signal processing circuit 112 that may be used in such situations to generate tactile vibration signals 214 in stereo from the bass component of the first signal 210A and the bass component of the second signal 210B.

FIG. 3 is a simplified block diagram of a signal processing circuit 112A according to some embodiments of the present disclosure. The signal processing circuit 112A may include a first filter 326A and a second filter 326B (sometimes referred to herein together as "filters 326"). In some embodiments, the filters 326 may be configured to pass a bass component of the first signal 210A and the second signal 210B to generate the first tactile vibration signals 214. For example, the filters 326 may comprise low-pass filters with a cutoff frequency of about 512 Hz (the top of the bass frequency range). In some embodiments, the filters 326 may comprise high-pass filters, band-pass filters, band-gap filters, other filters, adaptive filters, other suitable filters, and combinations thereof in addition to, or instead of, low-pass filters. Accordingly, the filters 326 may be configured to pass the entire bass frequency range, subsets of the bass frequency range, one or more frequency ranges outside of the bass frequency range, or combinations thereof.

In some embodiments, the first filter 326A may comprise a similar frequency and phase response to the second filter 326B. In other words, the filters 326 may share similar transfer functions and delay properties. In some embodiments, however, the frequency response, the phase response, and combinations thereof, may be different. In other words, the filters 326 may have different transfer functions, delay properties, or combinations thereof. Design choices to employ similar filters 326 or different filters 326 may influence the directional effect created by the resulting tactile vibrations.

Figure 4:
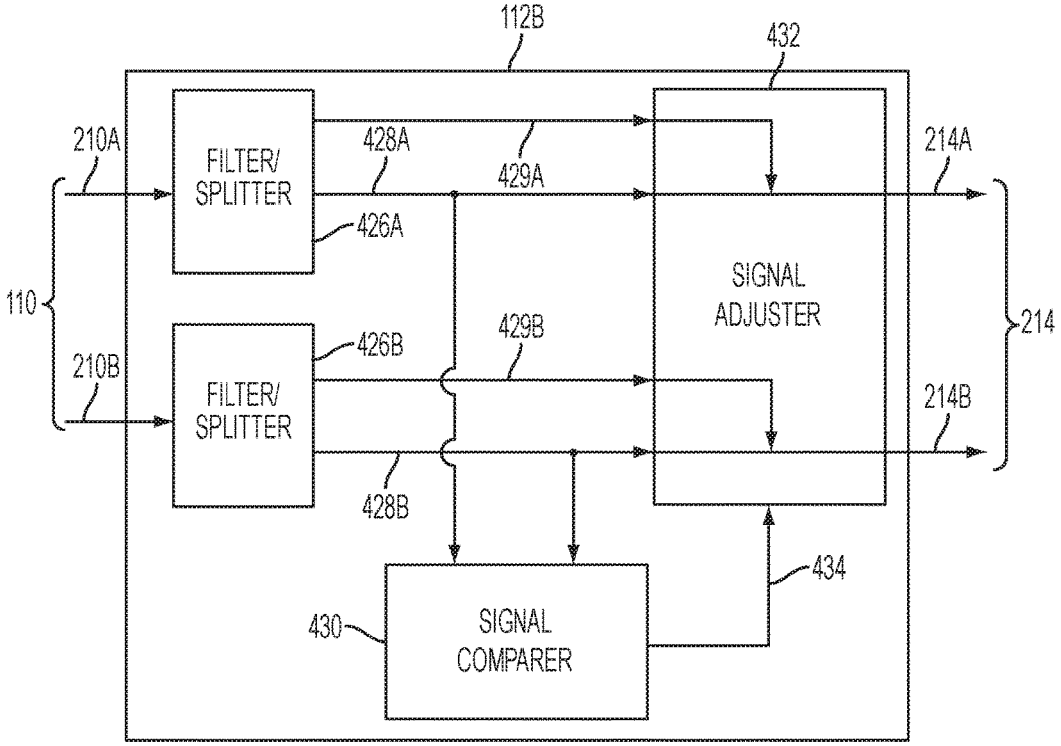
FIG. 4 is a simplified block diagram of another signal processing circuit.

In additional embodiments, it may not be known if the headphone 106 will likely be used in applications where the audio signal 110 is mixed with stereo bass. FIG. 4 illustrates a simplified block diagram of a non-limiting example of a signal processing circuit 112B that may be used to generate stereo tactile vibration signals 214 in such embodiments. The stereo tactile vibration signals 214 may be derived from (e.g., modulated based on) a component of the first signal 210A and a component of the second signal 210B.

The signal processing circuit 112B may include a first filter/splitter 426A and a second filter/splitter 426B (sometimes referred to herein together as "filters/splitters 426"), a signal adjuster 432 operably coupled to the filters/splitters 426, and a signal comparer 430 operably coupled to the filters/splitters 426 and the signal adjuster 432.

In some embodiments, the first filter/splitter 426A and the second filter/splitter 426B may be configured to pass the bass component of the first signal 210A and the bass component of the second signal 210B, respectively, to generate a first bass signal 428A, and a second bass signal 428B (sometimes referred to herein together as "bass signals 428"), respectively. Of course, as previously discussed, in some embodiments the bass signals 428 may include other frequency content from the audio signal 110. For example, the filters/splitters 426 may be configured to pass a subset of the bass frequencies of the audio signal 110 in an optimal performance range (e.g., 16 to 100 Hz) of the tactile bass vibrators 220.

The first filters/splitters 426 may also be configured to generate a first modulation signal 429A, and a second modulation signal 429B (sometimes referred to herein together as "modulation signals 429"). The modulation signals 429 may be generated by passing frequency content from the first signal 210A and the second signal 210B that is outside the frequency range of the bass signals 428. Sound engineers traditionally mix audio in the non-bass frequency range in stereo. Accordingly, the modulation signals 429 will often be stereo signals, even where the bass signals 428 are monophonic.

In some embodiments, the modulation signals 429 may comprise some or all of the frequency content of the audio signal 110 that are higher than the bass frequency range (e.g., higher than 512 Hz). In some embodiments, the modulation signals 429 may comprise some or all of the frequency content above the optimal frequency performance range of the tactile bass vibrators 220 (e.g., higher than 100 Hz). In some embodiments, the modulation signals 429 may comprise the unmodified audio signal 110. In some embodiments, the signal processing circuit 112B may be configured to receive an input from a user of the headphones 106 (FIGS. 1 and 2) indicating a frequency range from the audio signal 110 that should be passed to form the modulation signals 429. In some embodiments, the headphones 106 may be configured to provide a plurality of selectable frequency ranges (e.g., 100 Hz to 300 Hz, 250 Hz to 600 Hz, 500 Hz to 800 Hz, etc.) for inclusion in the modulation signals 429.

The signal adjuster 432 may be configured to receive and adjust one or both of the bass signals 428 to generate the first tactile vibration signals if the signal comparer 430 determines that the first bass signal 428A is substantially the same as the second bass signal 428B. In other words, the signal processing circuit 112B may be configured to output stereo tactile vibration signals 214 regardless of whether the bass signals 428 are mono or stereo. For example, the signal adjuster 432 may be configured to modulate the bass signals 428 with the modulation signals 429, such that, for example, the sound level of the bass signals 428 fluctuates up and down in a manner generally corresponding to the fluctuations in the modulation signals 429.

The signal comparer 430 may be configured to receive the first bass signal 428A and the second bass signal 428B from the first filter/splitter 426A and the second filter/splitter 426B, respectively. The signal comparer 430 may also be configured to compare the first bass signal 428A to the second bass signal 428B to determine how similar the first bass signal 428A is to the second bass signal 428B. By way of non-limiting example, the signal comparer 430 may be configured to compare differences in magnitude, phase, spectral content, other signal properties, or combinations thereof, between the first bass signal 428A and the second bass signal 428B. By way of non-limiting example, the signal comparer 430 may be configured to analyze the frequency content of the bass signals 428 (e.g., with a fast Fourier transform) to determine average magnitudes of the bass signals 428. Also by way of non-limiting example, the signal comparer 430 may be configured to analyze the frequency content of the bass signals 428 to determine magnitudes of fundamental frequencies of the bass signals.

The signal comparer 430 may further be configured to output a similarity signal 434 to the signal adjuster 432. The similarity signal 434 may be configured to indicate how similar the first bass signal 428A is to the second bass signal 428B. In some embodiments, the similarity signal 434 may include a binary signal, indicating that the first bass signal 428A is either the same or different from the second bass signal 428B. By way of non-limiting example, the signal comparer 430 may be configured to compare a magnitude (e.g., a real-time magnitude, a moving average, etc.) of the first bass signal 428A to a magnitude of the second bass signal 428B (e.g., by subtracting the magnitude of the second bass signal 428B from the magnitude of the first bass signal 428A). If the difference in magnitudes is greater than a predetermined threshold (e.g., 2 dB), the similarity signal 434 may indicate that the first bass signal 428A is different from the second bass signal 428B. In response, the signal adjuster 432 may output the first tactile vibration signal 214A comprising the first bass signal 428A, and the second tactile vibration signal 214B comprising the second bass signal 428B. If the magnitude is less than the predetermined threshold, however, the similarity signal 434 may indicate that the first bass signal 428A is substantially the same as the second bass signal 428B. In response, the signal adjuster 432 may be configured to output the first tactile vibration signal 214A and the second tactile vibration signal 214B, wherein at least one of the first tactile vibration signal 214A and the second tactile vibration signal 214B comprises an adjusted one of the first bass signal 428A, the second bass signal 428B, or combinations thereof.

As previously discussed, the signal adjuster 432 may be configured to adjust one or both of the bass signals 428 to generate the tactile vibration signals 214 if the signal comparer 430 determines that the first bass signal 428A is substantially the same as the second bass signal 428B. In other words, the signal adjuster 432 may be configured to convert substantially mono bass signals 428 to stereo tactile vibration signals 214. In some embodiments, the signal adjuster 432 may be configured to analyze the frequency content of the modulation signals 429 (e.g., using a fast Fourier transform algorithm) to determine fundamental frequencies of the modulation signals 429. For example, the signal adjuster 432 may be configured to designate one of the first modulation signal 429A and the second modulation signal 429B to be dominant. The signal adjuster 432 may be configured to compare a first magnitude of the fundamental frequency of the first modulation signal 429A to a second magnitude of the fundamental frequency of the second modulation signal 429B. The signal adjuster 432 may be configured to designate the first modulation signal 429A to be dominant if the first magnitude is greater (e.g., on average) than the second magnitude. Likewise, the signal adjuster 432 may be configured to designate the second modulation signal 429B to be dominant if the second magnitude is greater than the first magnitude.

The signal adjuster 432 may also be configured to add subharmonic frequencies (i.e., in ratios of 1/n of the fundamental frequencies, with n being integer values) of the determined fundamental frequencies of the modulation signals 429 that are within the optimal frequency performance range of the tactile bass vibrators 220 to the respective bass signals 428 to form the tactile vibration signals 214. For example, one or more subharmonic frequencies of the fundamental frequency of the designated dominant modulation signal 429 may be added to the corresponding bass signal 428 to form the corresponding tactile vibration signal 214. Although other frequencies may be added other than subharmonics of the fundamental frequencies (e.g., a resonant frequency of the tactile bass vibrators 220), subharmonic frequencies may produce a more natural effect than other frequencies. In some embodiments, the signal adjuster 432 may be configured to add subharmonics of the fundamental frequencies that are closest to the resonant frequencies of the tactile bass vibrators 220.

As a specific, non-limiting example, the fundamental frequency of the first modulation signal 429A may be 1200 Hz at a first magnitude, and the resonant frequency of the first tactile bass vibrator 220A may be 82 Hz. The first magnitude may be greater than the second magnitude (of the fundamental frequency of the second modulation signal 429B), and the first modulation signal 429A may be designated to be dominant. The signal adjuster 432 may add an 80 Hz signal (the 1/15 subharmonic of 1200 Hz), having the first magnitude, to the first bass signal 428A to form the first tactile vibration signal 214A. As a result, the first tactile vibration signal 214A may be different from the second tactile vibration signal 214B.

In some embodiments, the signal adjuster 432 may be configured to detect differences between the first modulation signal 429A and the second modulation signal 429B, and adjust the bass signals 428 to have similar differences. By way of non-limiting example, the signal adjuster 432 may be configured to detect magnitude and phase differences between the modulation signals 429. The signal adjuster 432 may be configured to change the magnitudes and phase differences of the bass signals 428 to have a similar magnitude and phase difference as the modulation signals 429. For example, the magnitude difference may be adjusted with amplifiers and attenuators, and the phase difference may be adjusted with delay circuits.

In some embodiments, the similarity signal 434 may be configured to indicate more than a binary determination of whether the bass signals 428 are mono or stereo. The similarity signal 434 may also be configured to indicate the degree to which, and/or the manner in which the first bass signal 428A is similar to the second bass signal 428B. By way of non-limiting example, the signal adjuster 432 may be configured to adjust at least one of the bass signals 428 in proportion to the degree of similarity between the bass signals 428. For example, if the bass signals 428 are relatively similar, the signal adjuster 432 may be configured to make more pronounced adjustments to the at least one of the bass signals 428. If, however, the bass signals 428 are relatively less similar, the signal adjuster 432 may be configured to make less pronounced adjustments to the at least one of the bass signals 428.

In addition to indicating the degree to which the bass signals 428 are similar, the similarity signal 434 may indicate the manner in which the bass signals 428 are different. For example, if the similarity signal 434 indicates a slight phase difference and a large magnitude difference between the bass signals 428, the signal adjuster 432 may generate first tactile vibration signals 214 with a relatively large phase difference, and a similar magnitude difference, in comparison to the bass signals 428.

Figure 5:
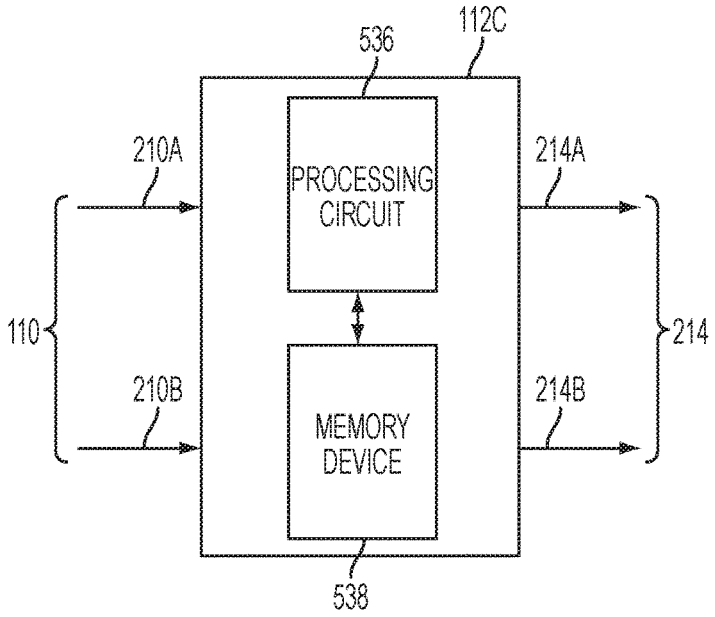
FIG. 5 is a simplified block diagram of another signal processing circuit.

FIG. 5 is a simplified block diagram of another signal processing circuit 112C. In some embodiments, the signal processing circuit 112C may include an electronic signal processor 536 operably coupled to a memory device 538. The memory device 538 may include a non-transitory computer-readable medium, such as a read-only memory (ROM), a flash memory, an electrically programmable read-only memory (EPROM), or any other suitable non-transitory computer-readable media. The memory device 538 may also comprise machine-readable instructions (e.g., software) stored on the memory device 538 and directed to implementing at least a portion of the function of the signal processing circuit 112C. By way of non-limiting example, the machine-readable instructions may be directed to implementing, in whole or in part, at least one of the first filter 326A and the second filter 326B of FIG. 3. Also by way of non-limiting example, the machine-readable instructions may be directed to implementing, in whole or in part, at least one element from the list consisting of the first filter/splitter 426A, the second filter/splitter 426B, the signal comparer 430, and the signal adjuster 432 of FIG. 4.

The electronic signal processor 536 may be configured to execute the machine-readable instructions stored by the memory device 538. By way of non-limiting example, the electronic signal processor 536 may include a microcontroller, an application specific integrated circuit (ASIC), a field programmable gate array (FPGA), a central processing unit (CPU), other suitable device capable of executing machine-readable instructions, or combinations thereof.

Figure 6:
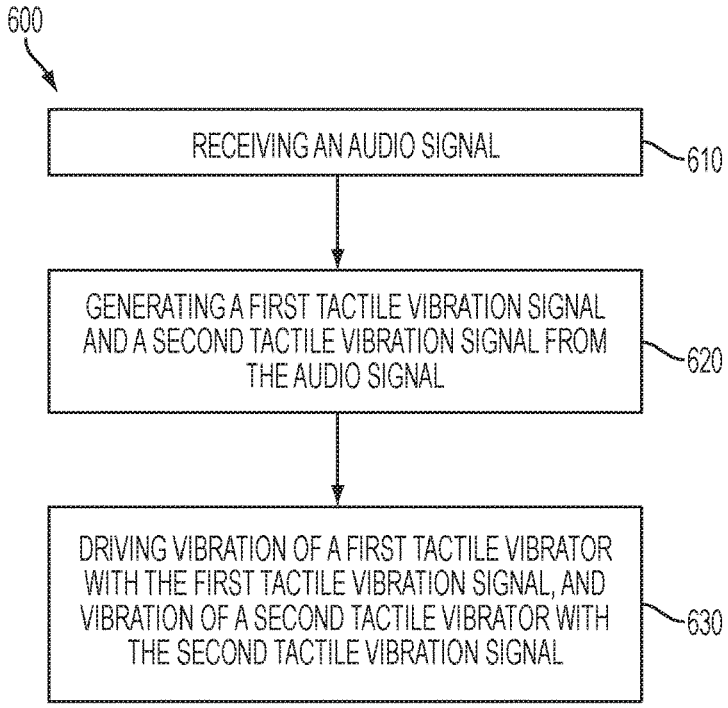
FIG. 6 is a flowchart illustrating a method of operating the stereo tactile vibrator system of FIGS. 1 and 2.

FIG. 6 is a flowchart 600 illustrating a method of operating the stereo tactile vibrator system 100 of FIGS. 1 and 2. Referring to FIGS. 2 and 6 together, at operation 610, the method may include receiving the audio signal 110 from the media player 108. Receiving the audio signal 110 may include receiving at least the first signal 210A and the second signal 210B, such as left and right channels of a stereo audio signal 110. Receiving the audio signal 110 may also include receiving the audio signal 110 wirelessly, through a cable assembly, or combinations thereof.

At operation 620, the method may include generating a first tactile vibration signal 214A and a second tactile vibration signal 214B from the audio signal 110. The first tactile vibration signal 214A is or may be different from the second tactile vibration signal 214B. In some embodiments, generating the tactile vibration signals 214 may include generating the tactile vibration signals 214 from a bass component of the audio signal 110. In some embodiments, generating the tactile vibration signals 214 may include generating stereo tactile vibration signals 214 from substantially monophonic bass components of the audio signal 110. In some embodiments, generating the tactile vibration signals 214 may include generating stereo tactile vibration signals 214 from stereo bass components of the audio signal 110. In some embodiments, generating the tactile vibration signals 214 may include modulating the bass components of the audio signal 110 with non-bass components of the audio signal 110.

At operation 630, the method may include driving vibration of the first vibrator 220A with the first tactile vibration signal 214A, and driving vibration of the second vibrator 220B with the second tactile vibration signal 214B. In some embodiments, vibrating the tactile bass vibrators 220 comprises amplifying the tactile vibration signals 214 with the amplifiers 216, and outputting the amplified signals 218 to the tactile bass vibrators 220. In some embodiments, vibrating the tactile bass vibrators 220 may include outputting the tactile vibration signals 214 directly to the tactile bass vibrators 220, if the tactile vibration signals 214 include sufficient power to drive the tactile bass vibrators 220.

Figure 7:
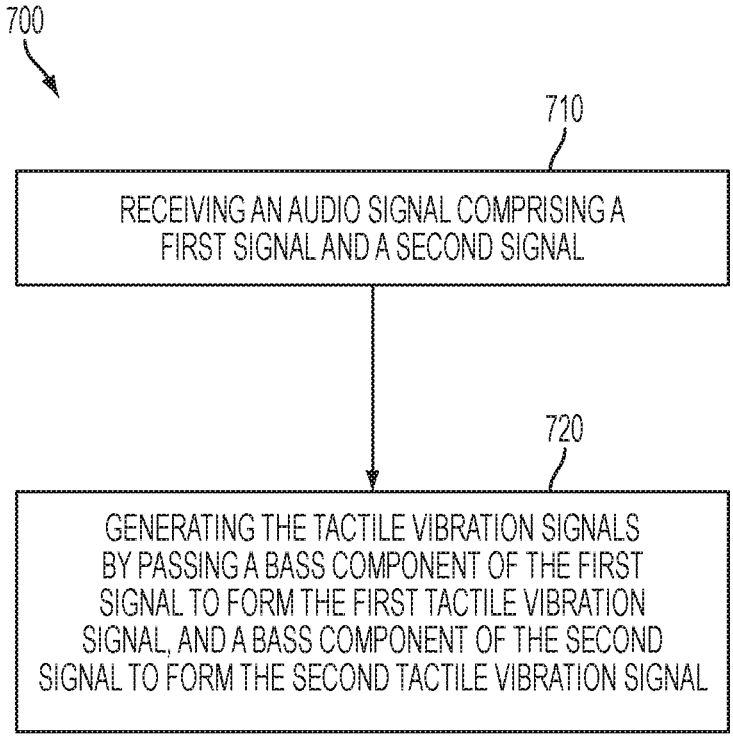
FIG. 7 is a flowchart illustrating a method of generating a first tactile vibration signal and a second tactile vibration signal from an audio signal.

FIG. 7 is a flowchart 700 illustrating a method of generating the first tactile vibration signal 214A and the second tactile vibration signal 214B from the audio signal 110. Referring to FIGS. 3 and 7 together, at operation 710, the method may include receiving the audio signal 110 comprising the first signal 210A and the second signal 210B. At operation 720, the method may comprise generating the tactile vibration signals 214 by passing a bass component of the first signal 210A to form the first tactile vibration signal 214A, and a bass component of the second signal 210B to form the second tactile vibration signal 214B. In some embodiments, passing the bass components of the audio signal 110 may include applying the audio signal 110 to the filters 326. In some embodiments, applying the audio signal 110 to the filters 326 may comprise applying the audio signal 110 to low-pass filters.

Figure 8:
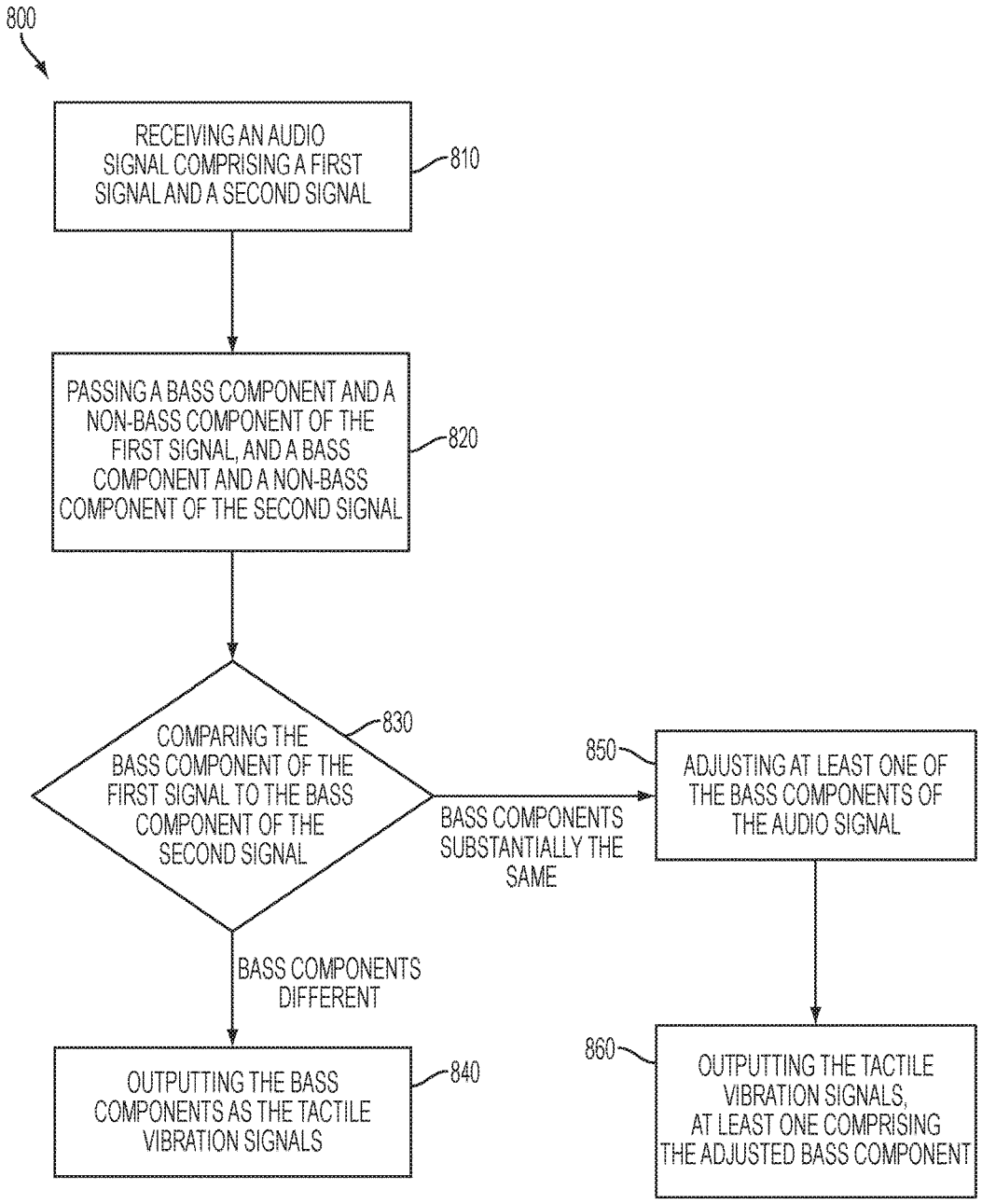
FIG. 8 is a flowchart illustrating another method of generating the first tactile vibration signal and the second tactile vibration signal from the audio signal.

FIG. 8 is a flowchart 800 illustrating another method of generating the first tactile vibration signal 214A and the second tactile vibration signal 214B from the audio signal 110. Referring to FIGS. 4 and 8 together, at operation 810, the method may comprise receiving the audio signal 110 comprising the first signal 210A and the second signal 210B (e.g., corresponding to left and right channels of the audio signal 110).

At operation 820, the method may comprise generating a bass component 428A and a non-bass component 429A of the first signal 210A, and a bass component 428B and a non-bass component 429B of the second signal 210B. In some embodiments, generating the bass component 428A and the bass component 428B may comprise passing bass components 428 of the respective first signal 210A and the second signal 210B with the filters/splitters 426. By way of non-limiting example, the bass components 428 may include a subset of the bass frequency range from their respective audio signals 210A, 210B that corresponds to an optimal performance frequency range of the tactile bass vibrators 220. Also by way of non-limiting example, the bass components 428 may include the entire bass frequency range, or other sub-sets of the bass frequency range from their respective audio signals 210A, 210B.

In some embodiments, generating the non-bass components 429 of the first signal 210A and the second signal 210B may comprise passing the non-bass components 429 with the filters/splitters 426. In some embodiments, generating the non-bass components 429 may comprise passing the frequency content of the audio signal 110 not included in the bass components 428. Passing the bass components 428 and the non-bass components 429 of the audio signal 110 may comprise applying the audio signal 110 to the filters/splitters 426.

At decision 830, the method may comprise comparing the bass component 428A of the first signal 210A to the bass component 428B of the second signal 210B. The comparison may be made with the signal comparer 430. By way of non-limiting example, comparing the first bass components 428 may comprise analyzing frequency content of the bass components (e.g., by performing a fast Fourier transform algorithm on the first bass component 428A and the second bass component 428B). In some embodiments, comparing the first bass component 428A to the second bass component 428B may also comprise determining an average first magnitude of the first bass component 428A and an average second magnitude of the second bass component 428B. In some embodiments, comparing the first bass component 428A to the second bass component 428B may also comprise comparing a first magnitude of a fundamental frequency of the first bass component 428A to a second magnitude of a fundamental frequency of the second bass component 428B. If the first magnitude and the second magnitude are different from each other by at least a predetermined threshold (e.g., 2 dB), then the bass components 428 may be determined to be different from each other. If however, the first magnitude and the second magnitude are within the predetermined threshold of each other, then the bass components 428 may be determined to be substantially the same.

If the bass components 428 are determined to be different, at operation 840 the method may comprise outputting the bass components 428 as the tactile vibration signals 214. Returning to decision 830, if the bass components 428 are determined to be substantially the same, at operation 850, the method may comprise adjusting at least one of the bass components 428 of the audio signal 110. In some embodiments, adjusting at least one of the bass components 428 may comprise modulating the bass components 428 with the non-bass components 429.

At operation 860, the method may comprise outputting the first tactile vibration signal 214A and the second tactile vibration signal 214B, at least one comprising an adjusted bass component. By way of non-limiting example, the adjusted bass component 428 may correspond to the dominant channel, and the adjusted bass component 428 may comprise the bass component 428 with energy added thereto.

Figure 9:
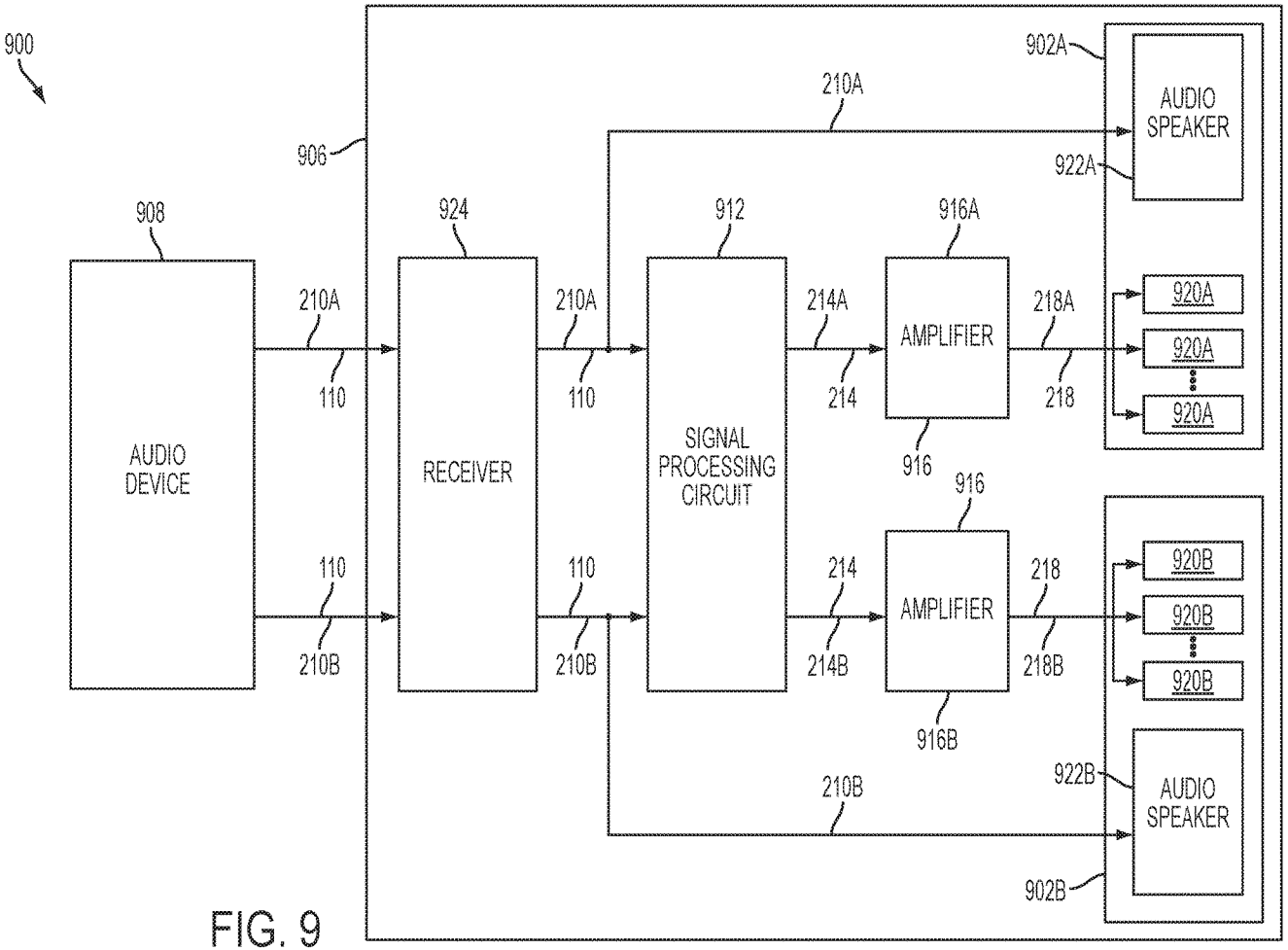
FIG. 9 is a simplified block diagram of another stereo tactile vibrator system of the present disclosure.

FIG. 9 is a simplified block diagram of another stereo tactile vibrator system 900, according to an embodiment of the present disclosure. The stereo tactile vibrator system 900 may be similar to the stereo tactile vibrator system 100 of FIG. 2. For example, the stereo tactile vibrator system 900 may include a media player 908, and a headphone 906 configured to receive an audio signal 110 from the media player 908, similar to the media player 108 and the headphone 106 of FIG. 2. The headphone 906 may include a receiver 924, a signal processing circuit 912, a first amplifier 916A, and a second amplifier 916B, each of which may be respectively similar to the receiver 124, the signal processing circuit 112, the first amplifier 216A, and the second amplifier 216B of the headphone 106 of FIG. 2. The headphone 906 may also comprise a first speaker assembly 902A and a second speaker assembly 902B. The first speaker assembly 902A and the second speaker assembly 902B may each comprise an audio driver 922A, 922B similar to the audio drivers 222A, 222B of the first speaker assembly 102A and the second speaker assembly 102B of FIG. 2.

The first speaker assembly 902A and the second speaker assembly 902B may also respectively comprise a first plurality of tactile bass vibrators 920A (sometimes referred to herein individually as "vibrator 920A," and together as "vibrators 920A") and a second plurality of tactile vibrators 920B (sometimes referred to herein individually as "vibrator 920B," and together as "vibrators 920B"), each similar to the tactile bass vibrators 220A, 220B of the speaker assemblies 102 of FIG. 2. In some embodiments, the vibrators 920A, 920B (sometimes referred to herein together as "vibrators 920") may be distributed spatially with reference to a surface of the speaker assembly 902 that contacts the user to cause a more uniform vibrational effect.

As previously discussed, the vibrators 920 may be configured to exhibit specific resonant frequencies. In some embodiments, a single speaker assembly 902 may comprise vibrators 920 that are each configured to resonate at the same frequency. In some embodiments, a single speaker assembly 902 may comprise at least one vibrator 920 that is configured to resonate at a different frequency than at least another vibrator 920 in that same speaker assembly 902. Consequently, the user may experience a relatively stronger vibrational response over a relatively wider range of frequencies, relative to a single vibrator speaker assembly.

In some embodiments, each of the speaker assemblies 902 may comprise vibrators 920 configured with resonant frequencies that are spread across the bass frequency range. By way of non-limiting example, each of the speaker assemblies 902 may comprise vibrators 920 that resonate at frequencies that evenly divide the bass frequency range (e.g., three vibrators 920 having resonant frequencies at approximately 140 Hz, 264 Hz, and 388 Hz, respectively). Also by way of non-limiting example, each of the speaker assemblies 902 may comprise vibrators 920 that resonate at the extremes of the frequency band (e.g., at 16 Hz and 512 Hz) or even outside of the generally accepted audible range (e.g., 10 Hz).

In some embodiments, the vibrators 920 may be removably coupled to the speaker assemblies 902, as previously discussed. As a result, the resonant frequencies of vibrators 920 in a speaker assembly 902 may be changed, removed, or added by respectively switching out, removing, or attaching vibrators 920 configured for different resonant frequencies. The user may select a variety of different configurations of vibrators 920 that exhibit various resonant frequencies to provide diverse vibrational experiences.

In addition to the variety of resonant frequencies that may be achieved by the headphone 906, the vibrators 920A, 920B may be configured respectively to receive different amplified signals 218A, 218B (e.g., amplified tactile vibration signals 214). The resulting experience may be a rich vibrational and directional experience that may not be achieved by traditional headphones.

As previously discussed, a headphone 106, 906 may be configured to convert audio signals 110 comprising monophonic bass components to stereo tactile vibration signals 214. In some embodiments, however, a media player 108, 908 may be configured to output audio signals 110 with stereo bass components.

Figure 10:
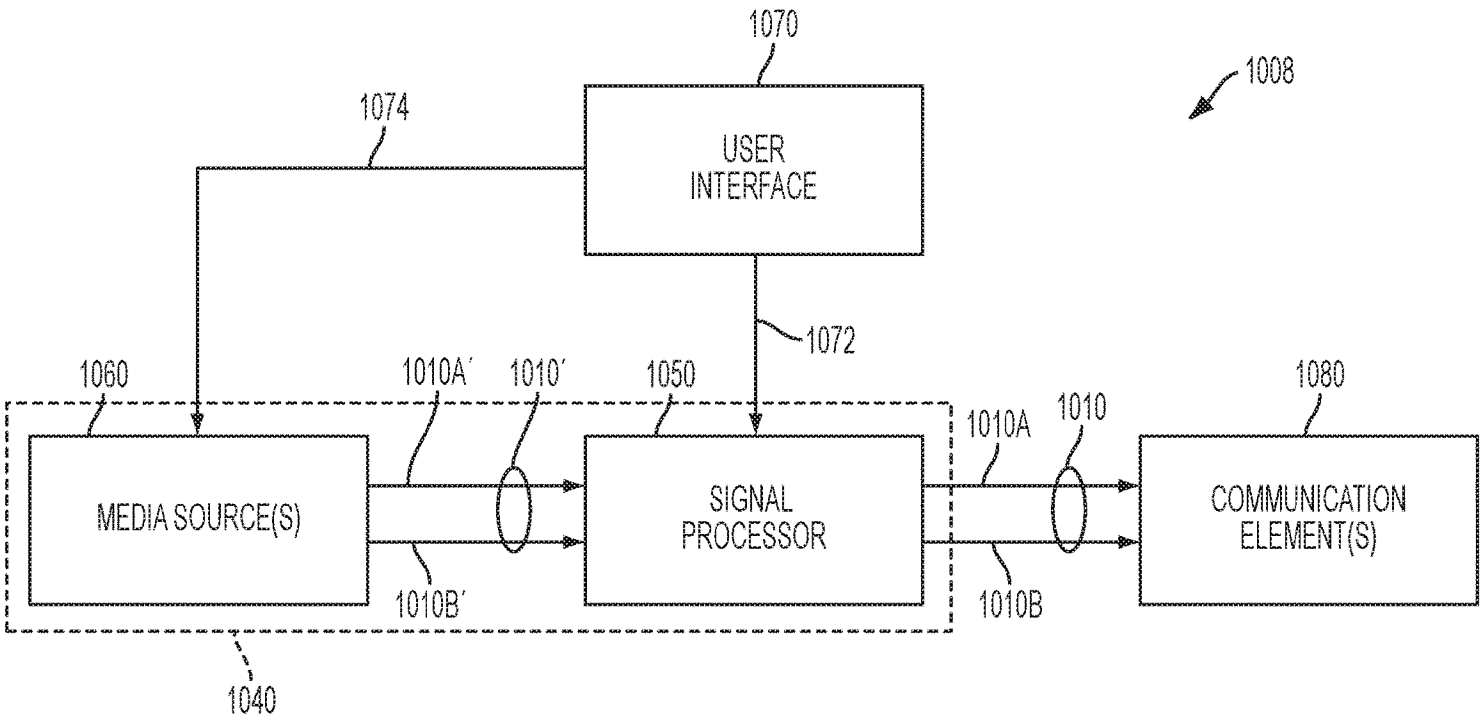
FIG. 10 is a simplified block diagram of a media player, according to an embodiment of the present disclosure.

FIG. 10 is a simplified block diagram of a media player 1008, according to an embodiment of the present disclosure. The media player 1008 may be configured to output an audio signal 1010, wherein the audio signal 1010 comprises stereo bass components. In other words, the media player 1008 may be configured to output a first signal 1010A and a second signal 1010B of the audio signal 1010, wherein a bass component of the first signal 1010A is different from a bass component of the second signal 1010B.

The media player 1008 may include a signal processor 1050 operably coupled to one or more media sources 1060, a user interface 1070, and one or more communication elements 1080. The media sources 1060 may output an unmodified audio signal 1010' comprising a first unmodified signal 1010A' and a second unmodified signal 1010B'. The unmodified audio signal 1010' may include either stereo or monophonic bass components. The signal processor 1050 may receive the unmodified audio signal 1010' from the media sources 1060 and output a stereo bass audio signal 1010. The stereo bass audio signal 1010 may comprise a first signal 1010A and a second signal 1010B, wherein a bass component of the first signal 1010A is different from a bass component of the second signal 1010B. In other words, the signal processor 1050 may be configured to output a stereo bass audio signal 1010 regardless of whether the bass components of the unmodified audio signal 1010' are stereo or monophonic. The signal processor 1050 may be configured to modify at least one of the first unmodified signal 1010A' and the second unmodified signal 1010B' to produce the first signal 1010A and the second signal 1010B, if the unmodified audio signal 1010' includes monophonic bass components. For example, the signal processor 1050 may be configured to modulate at least one of the bass components of the unmodified signal 1010' by a non-bass component of the unmodified signal 1010' to produce the stereo bass audio signal 1010. The signal processor 1050 may send the stereo bass audio signal 1010 to the communication elements 1080, which may communicate the stereo bass audio signal 1010 to a headphone 106, 906 (FIGS. 1, 2, and 9), or other audio output device.

The user interface 1070 may be configured to receive user inputs from a user of the media player 1008. The user inputs may be directed, in part, to controlling the media sources 1060. Thus, the user interface 1070 may be configured to send media controls 1074 to the media sources 1060. The user inputs may also be directed to influencing the manner in which the signal processor 1050 modifies an unmodified audio signal 1010' having monophonic bass components to produce the stereo bass audio signal 1010. For example, the user interface 1070 may be configured to enable the user to indicate a frequency range (e.g., 100 to 250 Hz, 250 to 600 Hz, 500 to 800 Hz, the entire frequency range of the signal, etc.) of the unmodified audio signal 1010' that should be used to modulate the bass components of the unmodified audio signal 1010' to produce the stereo bass audio signal 1010. Also, the user interface 1070 may be configured to enable the user to turn the signal processor 1050 on and off. When the signal processor 1050 is in an off state, the unmodified audio signal 1010' may be sent to the communication elements 1080 for communication to the headphones 106, 906 (FIGS. 1, 2, and 9). When the signal processor 1050 is in an on state, the signal processor 1050 may adjust the unmodified audio signal 1010' to produce the stereo bass audio signal 1010 when the unmodified audio signal 1010' includes monophonic bass components. Thus, the user interface 1070 may also be configured to send signal processor commands 1072 to the signal processor 1050.

In some embodiments, the media player 1008 may include a computing system 1040. The computing system 1040 may be configured with an operating system (e.g., WINDOWS®, IOS®, OS X®, ANDROID®, LINUX®, etc.), and the media sources 1060 and the signal processor 1050 may each comprise software applications configured for running on the operating system. The media sources 1060 may include software applications configured to output the unmodified audio signal 1010' (e.g., PANDORA®, YOUTUBE®, etc.). The media sources 1060 may be configured to cause the computing system 1040 to display graphical user interfaces (GUIs) configured to enable a user to control the media sources 1060. Accordingly, the user interface 1070 may include an electronic display (e.g., a liquid crystal display, a touchscreen, etc.), and one or more input devices (e.g., a touchscreen, buttons, keys, a keyboard, a mouse, etc.). The user interface 1070 may send the media controls 1074 to the media sources 1060 responsive to the user selecting options presented on the GUIs generated by the media sources 1060.

The signal processor 1050 may include a software application configured to produce the stereo bass audio signal 1010 from the unmodified audio signal 1010' produced by the media sources 1060. The signal processor 1050 may be configured to operate substantially in the background. In other words, the GUIs generated by the media sources 1060 may be displayed instead of a GUI generated by the signal processor 1050, unless the user is actively turning the signal processor 1050 on or off, or adjusting the settings of the signal processor 1050. In some embodiments, the signal processor 1050 may be configured to cause the computing system 1040 to display a selectable icon on the electronic display of the user interface 1070, and display the GUI generated by the signal processor 1050 responsive to detecting a user selection of the selectable icon. An example GUI generated by the signal processor 1050 is discussed below with respect to FIGS. 14 and 15.

As previously discussed, the signal processor 1050 may be implemented with software executed by the computing system 1040. In some embodiments, some or all of the signal processor 1050 may be implemented with a hardware chip configured to perform some or all of the functions of the signal processor 1050. For example, the hardware chip may be comprised by the media player 1008. Also, the hardware chip may be comprised by the headphone 106, 906 (FIGS. 1, 2, and 9). In some embodiments, a portion of the signal processor 1050 may be comprised by the headphone, and another portion of the signal processor 1050 may be comprised by the media player 1008. Furthermore, a portion of the signal processor 1050 may be implemented with software, and another portion of the signal processor 1050 may be implemented with hardware.

Also, the media sources 1060 may similarly be implemented as hardware, software, or a combination thereof. In some embodiments the media sources 1060 comprise audio disc readers, mp3 players, other media sources, or combinations thereof. In some embodiments, the media sources 1060 may be implemented as software executed by the same computing system 1040 as the signal processor 1050. In some embodiments, the media sources 1060 and the signal processor 1050 may be implemented as software executed by separate computing systems.

Figure 11:
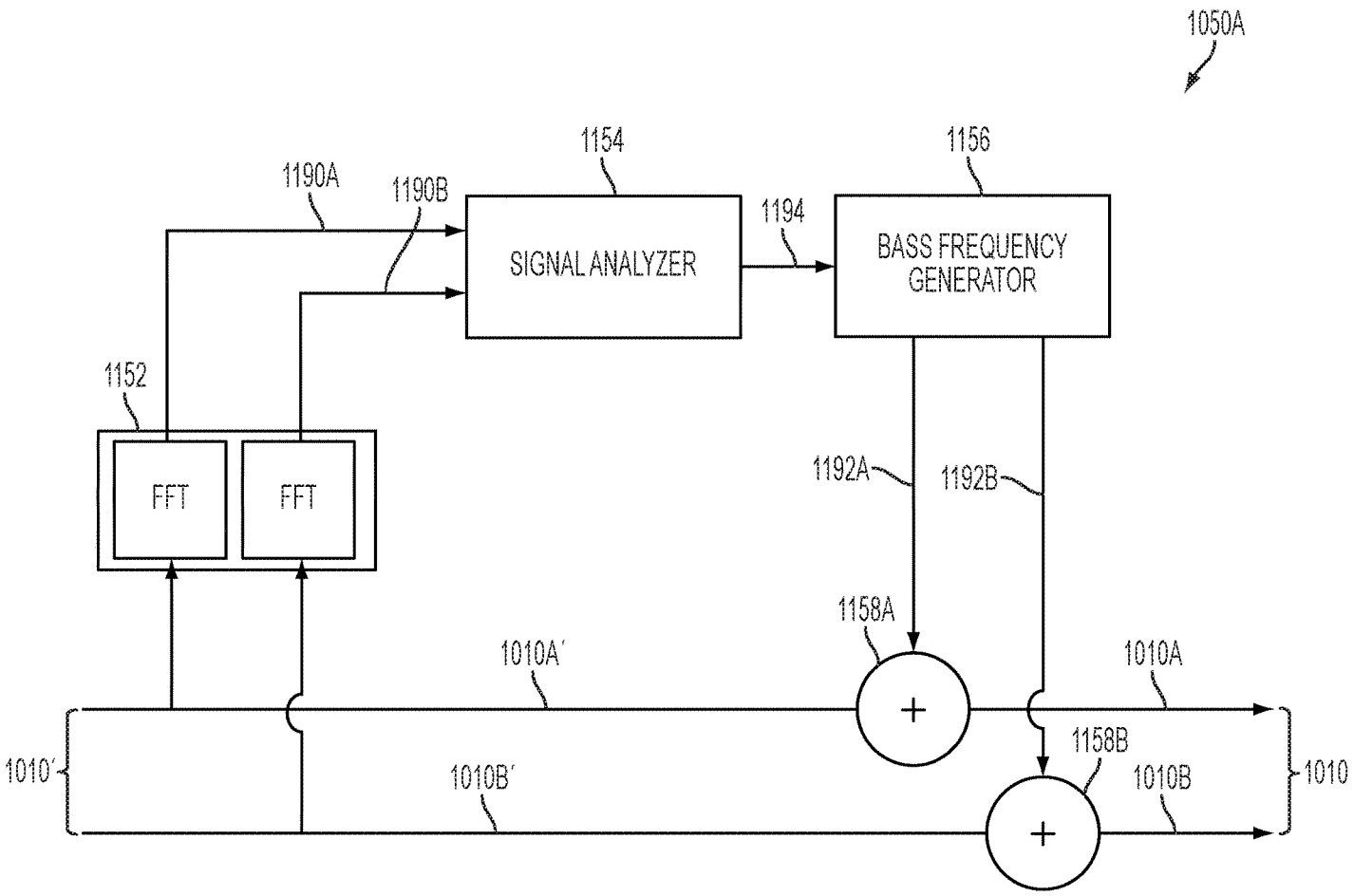
FIG. 11 is a simplified block diagram of a signal processor comprised by the media player of FIG. 10, according to an embodiment of the present disclosure.

FIG. 11 is a simplified block diagram of an example of a signal processor 1050A. The signal processor 1050A may include a fast Fourier transform module 1152, a signal analyzer 1154, a bass frequency generator 1156, a first adder 1158A and a second adder 1158B. The fast Fourier transform module 1152 may be configured to provide frequency information 1190A and 1190B (sometimes referred to herein together as "frequency information" 1190) from the first unmodified signal 1010A' and the second unmodified signal 1010B', respectively, to the signal analyzer 1154. The signal analyzer 1154 may be configured to analyze the frequency information 1190 to determine an average magnitude of bass (e.g., 20 to 100 Hz, 16 to 512 Hz, etc.) in each of the first unmodified signal 1010A' and the second unmodified signal 1010B'. For example, the signal analyzer 1154 may be configured to determine a first bass magnitude of a bass component of the first unmodified signal 1010A' and a second bass magnitude of a bass component of the second unmodified signal 1010B' (e.g., an average magnitude of the bass component, a magnitude of a fundamental frequency of the bass component, etc.). If the first magnitude is within a predetermined threshold (e.g., 2 dB) of the second magnitude, then the signal analyzer 1154 may determine that the unmodified audio signal 1010' includes monophonic bass. If, however, the first magnitude is not within the predetermined threshold of the second magnitude, then the signal analyzer 1154 may determine that the unmodified audio signal 1010' already includes stereo bass.

The signal analyzer 1154 may also be configured to send a frequency control signal 1194 to the bass frequency generator 1156. The signal analyzer 1154 may be configured to control the bass frequency generator 1156 via the frequency control signal 1194. The bass frequency generator 1156 may be configured to output a first added bass signal 1192A and a second added bass signal 1192B to the adders 1158A, 1158B. The adders 1158A, 1158B may be configured to add the first added bass signal 1192A and the second added bass signal 1192B to the first unmodified signal 1010A' and the second unmodified signal 1010B', respectively, to form the stereo bass audio signal 1010. For example, if the signal analyzer 1154 determines that the unmodified audio signal 1010' already includes stereo bass, the signal analyzer 1154 may cause the bass frequency generator 1156 to output a first added bass signal 1192A and a second added bass signal 1192B, each with zero magnitude. As a result, the stereo bass audio signal 1010 may be substantially the same as the unmodified audio signal 1010'.

If, on the other hand, the signal analyzer 1154 determines that the unmodified audio signal 1010' includes monophonic bass, the signal analyzer 1154 may cause the bass frequency generator 1156 to output a non-zero one or more of the first added bass signal 1192A and the second added bass signal 1192B. As a result, at least one of the first unmodified signal 1010A' and the second unmodified signal 1010B' may be modified to produce the stereo bass audio signal 1010.

In some embodiments, the signal analyzer 1154 may be configured to receive the signal processor commands 1072 (FIG. 10). The signal processor commands 1072 may indicate a frequency range of the unmodified audio signal 1010' to be used to modulate the unmodified audio signal 1010'. For example, if the signal processor commands 1072 indicate a first frequency range, the signal analyzer 1154 may be configured to determine which of the first unmodified signal 1010A' and the second unmodified signal 1010B' includes more energy within the first frequency range. The signal analyzer 1154 may detect a first magnitude of the first unmodified signal 1010A' and a second magnitude of the second unmodified signal 1010B'. By way of non-limiting example, the first magnitude may be an average magnitude of the first unmodified signal 1010A' over the first frequency range, and the second magnitude may be an average magnitude of the second unmodified signal 1010B' over the first frequency range. Also by way of non-limiting example, the first and second magnitudes may be the respective magnitudes of the fundamental frequencies within the first frequency range of each of the first unmodified signal 1010A' and the second unmodified signal 1010B'. The signal analyzer 1154 may designate the one of the first unmodified signal 1010A' and the second unmodified signal 1010B' that corresponds to a greater of the first magnitude and the second magnitude as a dominant channel.

The signal analyzer 1154 may cause the bass frequency generator 1156 to output the one of the added bass signals 1192A, 1192B that corresponds to the dominant channel with non-zero magnitude (e.g., the magnitude of the dominant channel in the first frequency range), and one or more frequencies near the resonant frequency (e.g., 35 to 60 Hz) of the tactile bass vibrators 120, 920 (FIGS. 2 and 9). In other words, the signal analyzer 1154 may cause a non-zero one of the added bass signals 1192A, 1192B to be added to the dominant one of the first unmodified signal 1010A' and the second unmodified signal 1010B' to form the stereo bass audio signal 1010. In some embodiments the signal analyzer 1154 may be configured to cause the one of the added bass signals 1192A, 1192B that corresponds to the dominant channel to include one or more subharmonic frequencies of the fundamental frequency of the first frequency range of the dominant channel.

Figure 12:
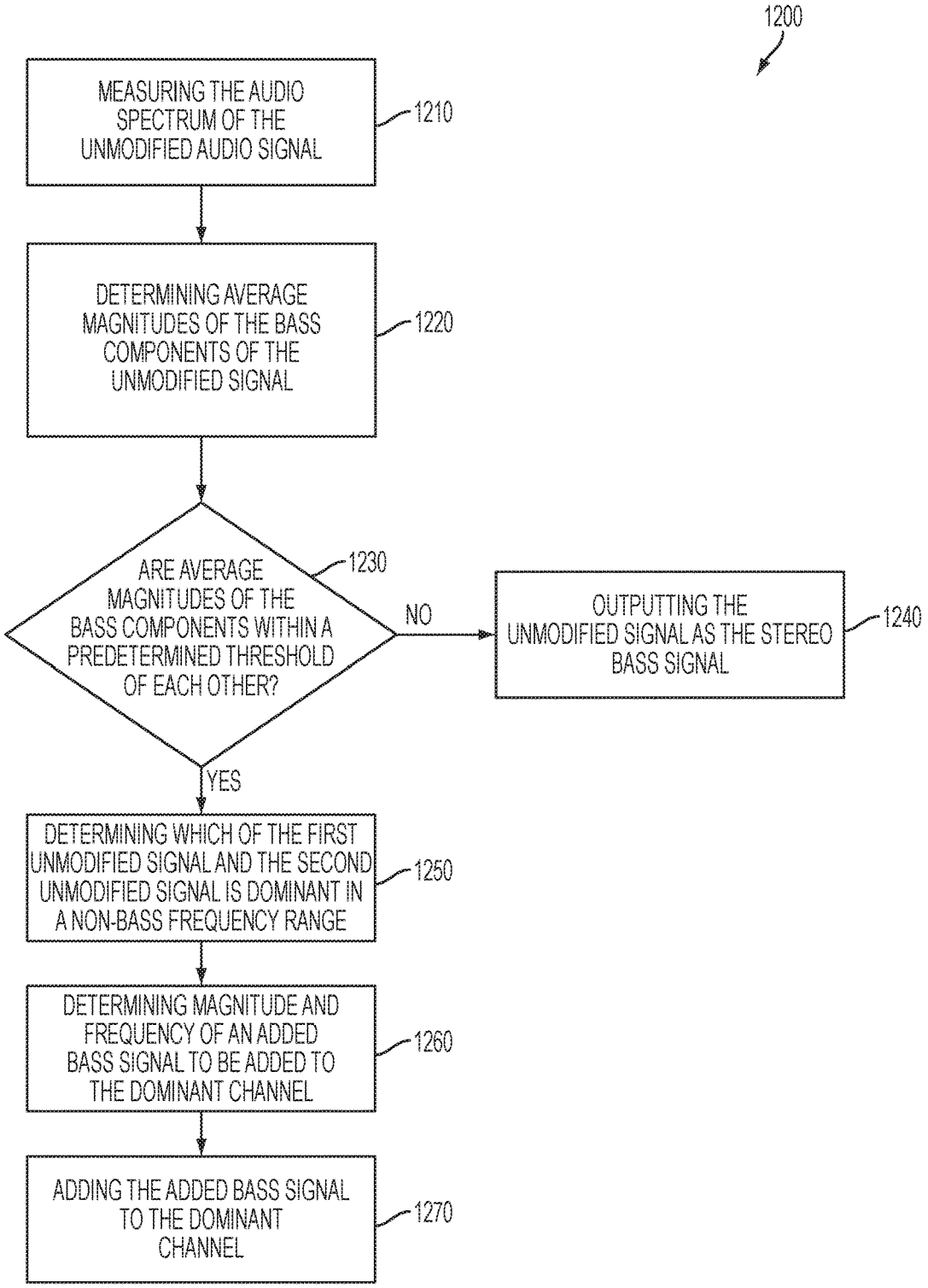
FIG. 12 is a flowchart illustrating a method of operating the media player of FIG. 10.

FIG. 12 is a flowchart 1200 illustrating a method of operating the media player 1008 of FIG. 10. At operation 1210 the method may comprise measuring the audio spectrum of the unmodified audio signal 1010'. Measuring the audio spectrum of the unmodified audio signal 1010' may include utilizing a fast Fourier transform algorithm to measure the frequency content of the unmodified audio signal 1010'. At operation 1220 the method may comprise determining average magnitudes of the bass components of the unmodified audio signal 1010'.

At decision 1230 the method may comprise determining if the average magnitudes of the bass components are within a predetermined threshold of each other. By way of non-limiting example, the predetermined threshold may be approximately 2 dB. If the average magnitudes of the bass components are not within the predetermined threshold of each other, at operation 1240, the method may comprise outputting the unmodified signal 1010' as the stereo bass signal 1010.

Returning to decision 1230, if the average magnitudes of the bass components are within the predetermined threshold of each other, at operation 1250 the method may comprise determining which of the first unmodified signal 1010A' and the second unmodified signal 1010B' is dominant in a non-bass frequency range. Determining which is dominant may comprise determining an average magnitude difference between the non-bass components of the unmodified audio signal 1010'. In some embodiments, determining the average magnitude difference between the non-bass components may comprise determining the average magnitude difference between a user-selected subset of frequencies of the non-bass components of the unmodified signal 1010'. In some embodiments, determining the average magnitude difference between the non-bass components of the audio signal 1010' may comprise determining a first magnitude of the first unmodified signal 1010A' and a second magnitude of the second unmodified signal 1010B', and determining which of the first and second magnitudes is greater. The determined dominant one of the first unmodified signal 1010A' and the second unmodified signal 1010B' may be the one of the first unmodified signal 1010A' and the second unmodified signal 1010B' that corresponds to the greater of the first magnitude and the second magnitude.

At operation 1260, the method may comprise determining a magnitude and a frequency of an added bass signal 1192 to be added to the determined dominant channel of the unmodified signal 1010'. By way of non-liming example, the added bass signal may comprise a subharmonic frequency of a fundamental frequency of the dominant channel of the unmodified signal 1010' in the non-bass frequency range. In some embodiments, the added bass signal 1192 may comprise the subharmonic frequency that is closest to a resonant frequency of the tactile bass vibrator 120, 920. In some embodiments, the added bass signal 1192 may comprise the resonant frequency of the tactile bass vibrator 120, 920. In some embodiments, the added bass signal 1192 may have a set predetermined magnitude. In some embodiments, the added bass signal 1192 may have the same magnitude as the fundamental frequency of the dominant channel.

At operation 1270, the method may comprise adding the added bass signal 1192 to the determined dominant channel of the unmodified audio signal 1010' to form the stereo bass signal 1010.

Figure 13:
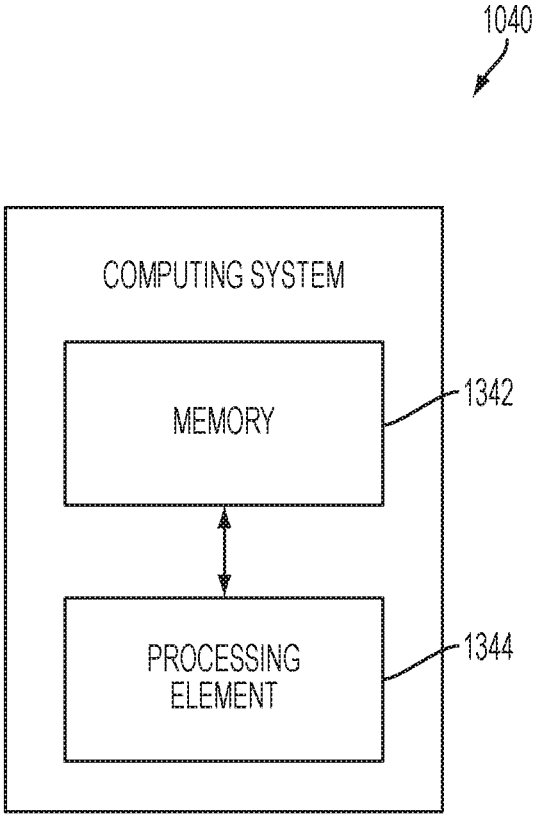
FIG. 13 is a simplified block diagram of a computing system.

FIG. 13 is a simplified block diagram of a computing system 1040. The computing system may comprise a memory 1342 operably coupled to a processing element 1344. The memory 1342 may comprise a volatile memory device, a non-volatile memory device, or a combination thereof. The memory 1342 may also comprise computer-readable instructions directed to implementing at least a portion of the functions the signal processor 1050 (FIG. 10) is configured to perform. By way of non-limiting example, the computer-readable instructions may be configured to implement the method illustrated by the flowchart 1200 of FIG. 12. In some embodiments, the computer readable instructions may also be directed to implementing at least a portion of the functions the media sources 1060 (FIG. 10) are configured to perform.

The processing element 1344 may be configured to execute the computer-readable instructions stored by the memory 1342. The processing element 1344 may comprise a microcontroller, a CPU, an application specific integrated circuit (ASIC), a field programmable gate array (FPGA), or other processing element configured for executing computer-readable instructions.

Figure 14:
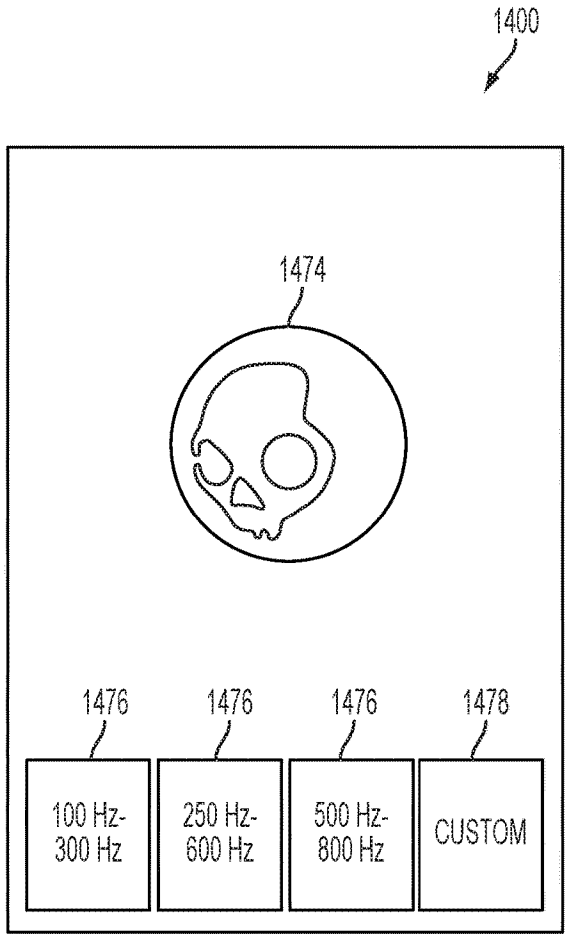

FIG. 14 is a simplified plan view of an exemplary graphical user interface (GUI) 1400 that may be used to control a signal processor 1050 (FIG. 10). As previously discussed, the signal processor 1050 may be implemented as a software application. Referring to FIGS. 10 and 14 together, a user of the GUI may run the signal processor 1050 software application, and the GUI 1400 may be displayed. The GUI 1400 may be configured to display an on/off option 1474, a plurality of predetermined modulation frequency options 1476 (sometimes referred to herein as "predetermined options" 1476), and a custom frequency option 1478. Responsive to a detection of a user selection of the on/off option 1474 while the signal processor 1050 is in an off state, the signal processor 1050 may transition to an on state. Likewise, responsive to a detection of a user selection of the on/off option 1474 while the signal processor 1050 is in an on state, the signal processor 1050 may transition to an off state. As previously discussed, when the signal processor 1050 is in an off state, the unmodified audio signal 1010' may be sent to the communication elements 1080 for communication to the headphones 106, 906 (FIGS. 1, 2, and 9). When the signal processor 1050 is in an on state, the signal processor 1050 may adjust the unmodified audio signal 1010' to produce the stereo bass audio signal 1010 when the unmodified audio signal 1010' includes monophonic bass components.

Responsive to the user selecting one of the predetermined options 1476, the signal processor 1050 may modulate at least one of the bass components of the unmodified audio signal 1010' with portions of the unmodified audio signal 1010' from the frequency range corresponding to the selected predetermined option 1476. For example, if the user selects the "250 Hz-600 Hz" predetermined option 1476, the signal processor 1050 may modulate at least one of the bass components with portions of the unmodified audio signal 1010' from the 250 to 600 Hz frequency range. Responsive to the user selecting any of the on/off option, or the predetermined options 1476, the GUI may close, and the signal processor 1050 may run in the background.

Responsive to the user selecting the custom frequency option 1478, the user may be prompted to select or input a custom frequency range to be used for modulating monophonic bass components. For example, responsive to the user selecting the custom frequency option 1478, the GUI 1400 may be configured to display the options illustrated in FIG. 15.

Figure 15:
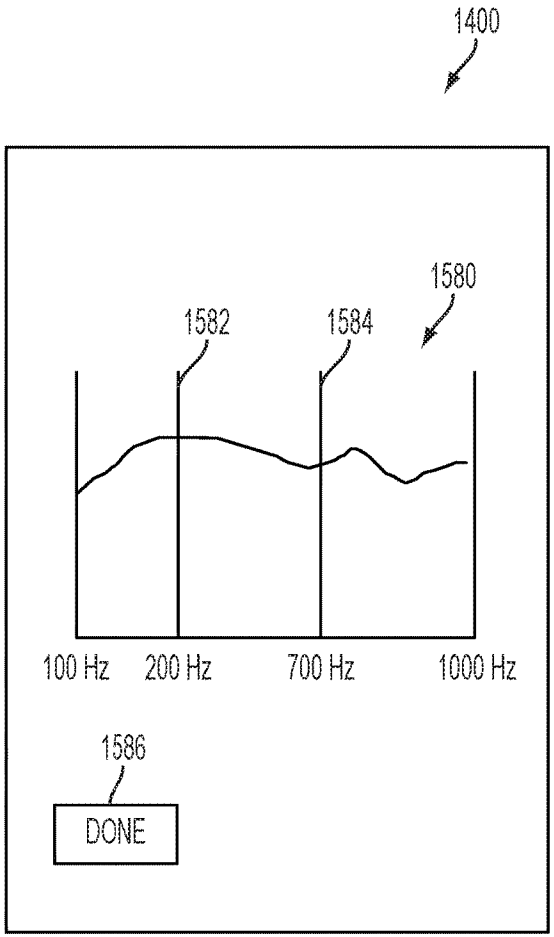
FIGS. 14 and 15 are simplified plan views of an exemplary graphical user interface that may be used to control the signal processor of FIG. 10.

FIG. 15 is a simplified plan view of the GUI 1400 of FIG. 14 after a user selects the custom frequency option 1478 of FIG. 14. The GUI 1400 may be configured to display a frequency plot 1580 of the unmodified audio signal 1010', a low-frequency bar 1582 and a high-frequency bar 1584. By way of non-limiting example, the low-frequency bar 1582 and the high-frequency bar 1584 may be movable by the user to identify the desired boundaries of the modulation frequency range. The GUI 1400 may also be configured to display a done option 1586. Responsive to a detection of a user selection of the done option 1506, the GUI 1400 may close, and the signal processor 1050 may modulate at least one of the bass components of the unmodified audio signal 1010' with portions of the unmodified audio signal 1010' from the modulation frequency range designated by the user with the GUI 1400. The signal processor 1050 may continue functioning in the background.

While certain illustrative embodiments have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including legal equivalents. In addition, features from one disclosed embodiment may be combined with features of another disclosed embodiment while still being encompassed within the scope of embodiments encompassed by the disclosure as contemplated by the inventors.

What is claimed is:

1. A headphone, comprising:

a first speaker assembly including a first audio driver and a first tactile bass vibrator;

a second speaker assembly including a second audio driver and a second tactile bass vibrator;

a signal comparer configured to compare a first bass component of an audio signal to be sent to the first speaker assembly to a second bass component of an audio signal to be sent to the second speaker assembly;

a filter configured to pass the first bass component to the first tactile bass vibrator and to pass the second bass component to the second tactile bass vibrator only when the first bass component is different from the second bass component; and a signal adjuster configured to modulate the first bass component and to modulate the second bass component to produce stereo bass only when the first bass component is at least substantially the same as the second bass component.

2. The headphone of claim 1, wherein each of the first speaker assembly and the second speaker assembly comprises a plurality of tactile bass vibrators configured to resonate at different resonant frequencies.

3. The headphone of claim 1, wherein the first tactile bass vibrator and the second tactile bass vibrator are removably coupled to the first speaker assembly and the second speaker assembly, respectively.

4. The headphone of claim 3, wherein:

the first speaker assembly further comprises a plurality of first tactile bass vibrators removably coupled to the first speaker assembly; and the second speaker assembly further comprises a plurality of second tactile bass vibrators removably coupled to the second speaker assembly.

5. A system comprising the headphone of claim 1 and a media player operably coupled to the headphone and configured to provide the headphone with the audio signal.

6. The system of claim 5, wherein the media player comprises a signal processor configured to modulate at least one channel of an unmodified audio signal from a media source with a non-bass component of the unmodified audio signal to output an audio signal comprising stereo bass components.

7. A system, comprising:

a headphone comprising:

a first speaker assembly including a first audio driver and a first tactile bass vibrator;

a second speaker assembly including a second audio driver and a second tactile bass vibrator, a signal comparer configured to compare a first bass component of an audio signal to be sent to the first speaker assembly to a second bass component of an audio signal to be sent to the second speaker assembly;

a filter configured to pass the first bass component to the first tactile bass vibrator and to pass the second bass component to the second tactile bass vibrator when the first bass component is different from the second bass component; and a signal adjuster configured to modulate the first bass component and to modulate the second bass component to produce stereo bass when the first bass component is at least substantially the same as the second bass component; and a media player operably coupled to the headphone and configured to provide the headphone with the audio signal, the media player comprising a signal processor configured to modulate at least one channel of an unmodified audio signal from a media source with a user-selected portion of a non-bass component of the unmodified audio signal to output an audio signal comprising stereo bass components.

8. A headphone, comprising:

a first speaker assembly including a first audio driver and a first tactile bass vibrator;

a second speaker assembly including a second audio driver and a second tactile bass vibrator; and a signal processing circuit configured to generate a first tactile vibration signal and a second tactile vibration signal from an audio signal comprising a first channel to be sent to the first audio driver and a second channel to be sent to the second audio driver, the first tactile vibration signal driving vibration of the first tactile bass vibrator and the second tactile vibration signal driving vibration of the second tactile bass vibrator, wherein the signal processing circuit is configured to output a bass component of the first channel as the first tactile vibration signal and a bass component of the second channel as the second tactile vibration signal only when the bass component of the first channel is different from the bass component of the second channel, and to modulate the bass component of the first channel and to modulate the bass component of the second channel only when the bass component of the first channel is the same as the bass component of the second channel.

9. The headphone of claim 8, wherein the signal processing circuit comprises:

a first frequency filter configured to pass the bass component of the first channel while filtering other components of the first channel only when the bass component of the first channel is different from the bass component of the second channel; and a second frequency filter configured to pass the bass component of the second channel while filtering other components of the second channel only when the bass component of the first channel is different from the bass component of the second channel.

10. The headphone of claim 9, wherein the signal processing circuit further comprises:

a first signal amplifier configured to amplify the bass component passed from the first frequency filter only when the bass component of the first channel is different from the bass component of the second channel; and a second signal amplifier configured to amplify the bass component passed from the second frequency filter only when the bass component of the first channel is different from the bass component of the second channel.

11. The headphone of claim 8, wherein the signal processing circuit comprises:

a first frequency filter and separator configured to separate and pass the bass component of the first channel and a non-bass component of the first channel only when the bass component of the first channel is substantially the same as the bass component of the second channel; and a second frequency filter and separator configured to separate and pass the bass component of the second channel and a non-bass component of the second channel when thoonly when the bass component of the first channel is substantially the same as the bass component of the second channel.

12. The headphone of claim 8, wherein the signal processing circuit comprises a signal comparer configured to compare the bass component of the first channel and the bass component of the second channel and generate a similarity signal indicating a difference between the bass component of the first channel and the bass component of the second channel.

13. The headphone of claim 8, wherein each of the first speaker assembly and the second speaker assembly comprises a plurality of tactile bass vibrators configured to resonate at different resonant frequencies.

* * * * *